United States Patent [19]

Pohlman et al.

[11] 4,242,851

[45] Jan. 6, 1981

[54] POLE CONSTRUCTION

[76] Inventors: Joe C. Pohlman, P.O. Box 15098, Pittsburgh, Pa. 15237; James P. Romualdi, 5737 Wilkins Ave, Pittsburgh, Pa. 15213

[21] Appl. No.: 30,441

[22] Filed: Apr. 16, 1979

Related U.S. Application Data

[63] Continuation-in-part of Ser. No. 841,740, Oct. 13, 1977, abandoned.

[51] Int. Cl.[2] ..... E04G 21/00

[52] U.S. Cl. ..... 52/743; 52/741; 52/726

[58] Field of Search ..... 52/725, 726, 727, 296, 52/297, 423, 722, 728, 743, 741; 403/265, 267

[56] References Cited

U.S. PATENT DOCUMENTS

| | | | |
|---|---|---|---|
| 470,153 | 3/1892 | Dorward | 402/265 |
| 1,018,754 | 2/1912 | Ford | 52/727 |
| 3,646,719 | 3/1972 | Archer et al. | 52/297 |

*Primary Examiner*—Carl D. Friedman

*Attorney, Agent, or Firm*—Paul Bogdon

[57] ABSTRACT

A pole construction having a generally telescoping configuration between its ends and the method of forming such a pole are disclosed. The pole is formed of longitudinally axially aligned cylindrical structural steel tubes. Each section of tube is of a uniform outer diameter and the respective sections progressively decrease in outer diameter. One end section of a larger tube overlaps the end section of the next smaller tube. An annular body of a non-metallic non-shrinking settable material such as concrete fills the space between the overlapping end sections of the tubes and rigidly secures the overlapping tubes to each other.

7 Claims, 6 Drawing Figures

POLE CONSTRUCTION

CROSS-REFERENCE TO RELATED APPLICATION

This application is a continuation-in-part of our earlier application, Ser. No. 841,740, filed Oct. 13, 1977, abandoned.

BACKGROUND OF THE INVENTION

This invention relates to pole type structural support members and particularly to a pole construction which may be used to support electrical transmission lines and related components either singly or by combining several to form a frame or lattice. Also, this invention relates to the method of forming such a pole construction. Pole structures commonly used for supporting transmission lines are either wood, pre-stressed concrete, or hollow tubular steel. Structural steel or aluminum are commonly used for constructing frames and lattices. As to poles, the hollow tapered steel construction has widespread use. Such poles are usually formed by bending steel sheets or plates on a press brake to form two half sections which would then be seam welded to produce sections of the pole. The various sections would then be butt welded to each other to form the tapered pole. Another method of constructing tapered steel poles is to shape the individual sections such that a larger section would slip into the end of a smaller section and be pressed at the overlap to secure the sections together to form the pole.

Regardless of which method is used to form tapered steel poles, each has the inherent problem of being expensive to produce mainly because of the complex costly equipment required for their production. The steel sheet or plate must be cut to shape, pressed into rounded or near rounded shapes and then seam and butt welded as described above. Each stage of production requires its own particular piece of equipment with each operation being time consuming and thus expensive. In addition to the expense, obtaining good, strong butt welds is always a major problem. It is vital to obtain a welded joint having the full tensile strength of the pole section. Because of the difficulty of obtaining high strength welds, high strength steel sheet or plate cannot always be used.

This invention overcomes the problems inherent in producing tapered poles by providing a pole construction formed of inexpensively produced straight tubular sections which are joined withoug welding to form a pole of progressively decreasing outer diameter. The pole construction of this invention has strong non-welded joints, resists both axial tension and compression loads as well bending moments imparted to the overall structure, and may be constructed without the need of high-priced complex equipment.

SUMMARY OF THE INVENTION

The present invention provides a novel pole construction such as would be used for supporting electrical transmission lines and allied components, and a novel method for forming the pole. A single unit of the pole construction, in its preferred form, includes a plurality of longitudinally aligned elongated structural tubes, each of the tubes being of a uniform outer dimension, all of the tubes having progressively decreasing outer dimensions, with one end section of a larger dimension tube overlapping the end section of the next smaller dimensioned tube; and an annular body of non-metallic non-shrinking means, such as a body of concrete, filling the space and adhering to the opposing surfaces of the overlapping end sections between the overlapping end sections of the tubes for rigidly securing the overlapping tubes to each other. The tubes and annular body are constructed and arranged with respect to each other such that the joints formed between the tubes resist both axial tension and compression loads as well as bending moments imparted to the tubes. The tubes may be cylindrically shaped steel tubes longitudinally axially aligned. Also, the tubes have their respective interiors unobstructed as regards any structural filler material such as would cause a detrimental shift of the neutral axis of the overall pole structure. Spacers may be provided between the overlapping tubes to assure concentricity. In addition, shear connectors may be provided between the overlapping tubes within the space formed therebetween. The method of the present invention preferably comprises the steps of longitudinally aligning the structural tubular members; positioning the larger dimensioned tubular member such that one end section overlaps an end section of the smaller tubular member; and filling the space between the overlapping tubular members with a non-metallic, non-shrinking material, such as concrete to secure the members to each other. The steps may be repeated to provide a pole of desired length.

Various advantages, details and modifications of the present invention will become apparent as the following description of a present preferred embodiment and present preferred method of making the embodiment proceed.

BRIEF DESCRIPTION OF THE DRAWINGS

In the accompanying drawings we show a present preferred embodiment of this invention in which.

Figure 1:
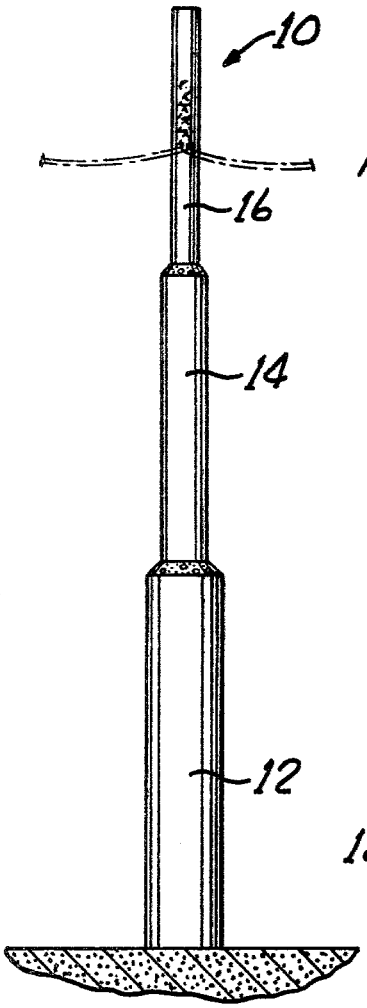
FIG. 1 is an elevation view partly in section of a pole construction embodying the present invention.

Referring now to the drawings, 10 represents the pole construction of this invention which includes a plurality of elongated, cylindrical structural tube members 12, 14 and 16, all being longitudinally axially aligned with each other. Three tube members 12, 14 and 16 are shown but two or more than three may be used to produce a pole construction of a desired length. The pole construction 10 shown and described herein could be of the type used by itself in supporting electrical transmission lines and related apparatus but it is to be understood that the pole construction is not limited to that type of application. Also, several units of the pole construction 10 could be combined by suitably interconnecting them to form H-frames or other type frames and lattices.

The tube members 12, 14 and 16 are formed from a suitable metal such as steel, with each tube member having a uniform outer dimension as measured from its longitudinal axis or, in the case of the tube members described, a uniform outer diameter. The outer diameters of the tube members 12, 14, 16 decrease progressively from the bottom tube member 12 to the top tube member 16. Thus, the pole construction 10 has a telescoping-type configuration. It is to be noted that a frame could be formed by combining several units of the pole construction 10 where the tube members increase progressively in outer diameter from the bottom member to the top member.

Tube member 12 is secured to tube member 14 which in turn is secured to tube member 16. The securing means are the same between the respective tube members 12 and 14, 14 and 16, with FIGS. 2–5 illustrating the securing means for tube members 12 and 14.

Figure 2:
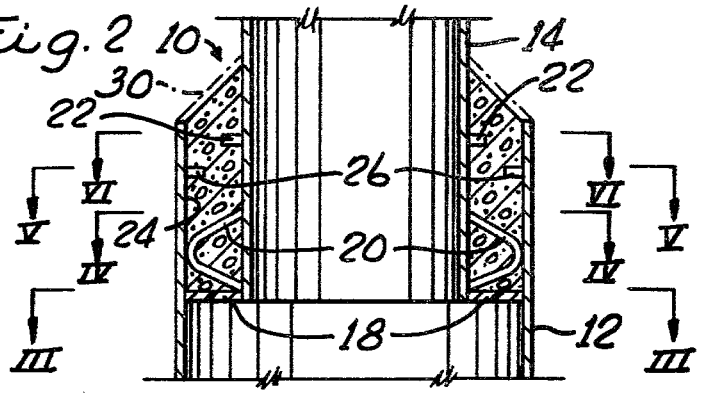
FIG. 2 is an enlarged sectional view of a portion of the pole construction of FIG. 1 showing details of construction of two of the tubular members at their overlapping position.
Figure 6:
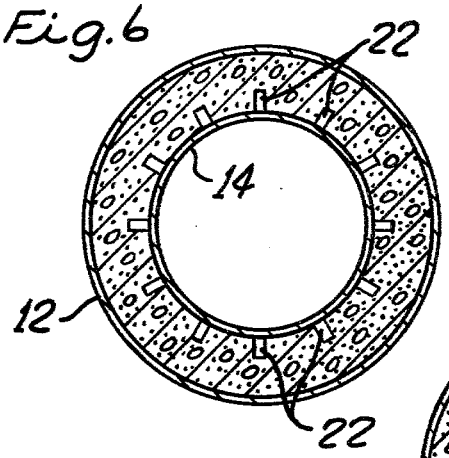
FIG. 6 is a view looking along the line VI—VI of FIG. 2.
Figure 5:
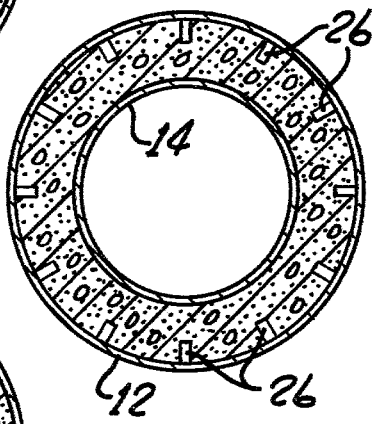
FIG. 5 is a view looking along the line V—V of FIG. 2.
Figure 4:
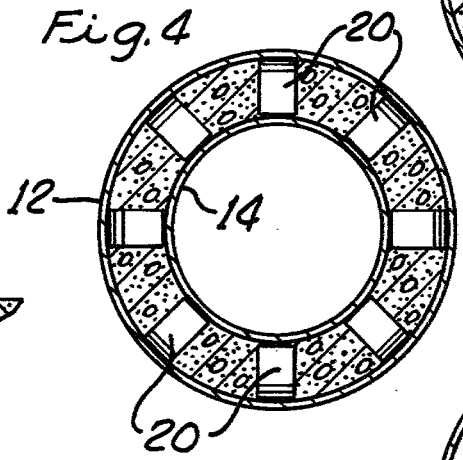
FIG. 4 is a view looking along the line IV—IV of FIG. 2.
Figure 3:
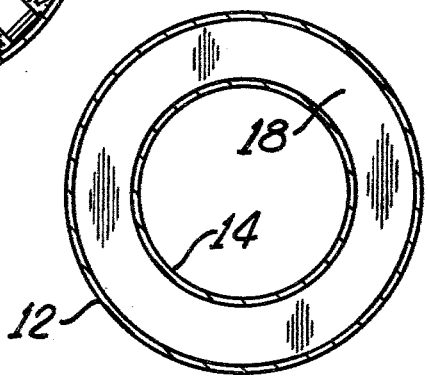
FIG. 3 is a view looking along the line III—III of FIG. 2.

As shown in FIG. 2, the upper end section of tube member 12 concentrically overlaps a lower end section of tube member 14. The longitudinal length of the overlap between the tube members 12 and 14 would vary depending on the size of the respective tube members with the overlap length in all cases being long enough to provide a strong connection between the tube members as will be more fully elaborated upon hereafter. When making the pole construction 10, a ring 18 of plastic material may be force fitted on the lower end of the tube member 14, the ring serving as a dam for stopping settable material, as will be described more fully hereinafter. Also, generally S-shaped metal spacer elements 20 are secured about the outer periphery of the lower end section of tube member 14. In addition, optional stud-type shear connectors 22 may be secured by any suitable method about the outer periphery of the tube member 14, above the spacer elements 20. With the ring-dam 18, spacer elements 20, and shear connectors 22 in place, the tube members 12 and 14 are positioned in the overlapping relationship shown in FIG. 2. The spacer elements 20 will insure the longitudinal axial alignment between the tube members 12 and 14. The ring-dam 18 will close the lower end of the annular space 24 defined between the overlapping end sections of the tube members 12 and 14. Shear connectors 26 may also be provided about the inner periphery of the tube member 12.

With the tube members 12 and 14 in the overlap position as described in the preceding paragraph, a frustoconical dam 30, shown in phantom outline in FIG. 2, may be arranged on the upper end of tube member 14. A non-metallic, non-shrinking settable material is then poured through an opening provided in dam 30 into the space 24 until that space and the space beneath dam 30 is filled. The settable material may be a non-shrinking concrete, mortar, grout, a suitable plastic, or the like. Thus an annular body 32 of settable material is formed within space 24 to secure the tube members 12 and 14 to each other. The shear connectors 22 and 26 will provide additional strength to the connection between the tube members.

After the material has set to form body 32, the dam 30 is removed. The sloped upper end of body 32 will assure water runoff.

As indicated earlier, the longitudinal length of the annular space 24 which is the overlap of the tube members 12 and 14 should be long enough to provide a strong connection between the tube members. A strong connection would be one which resist both axial tension and compression loads as well as bending moments imparted to the overall pole construction 10 such as, for example, would typically exist on a pole supporting electrical transmission lines and related apparatus. As an illustration of these characteristics, bending test and strength tests were conducted on a pole construction formed of six foot long sections of ten and fourteen inch diameter pipes having a twenty inch overlap. The overlap annulus was filled with a pre-packaged patching concrete mixture. The test results showed that the full bending strength of the smaller diameter tube was realized and that the joint formed between the overlapping tubes members withstood large axial loads in tension and compression. The test results were achieved with the joint being provided with and without shear connectors 22 and 26.

The interiors of the tube members 12 and 14 are generally unobstructed. As used in this invention "generally unobstructed" means that there is no filler material or other structural members within the tube members 12 and 14 which would have the detrimental effect of shifting the neutral axis of the pole construction 10. Such a shift of neutral axis would happen if the tube members 12 and 14 were filled with a structural material such as concrete, rigid foam, or the like. The expression "generally unobstructed" as used herein would allow for non-structural filler material such as a lightweight foam material which might be used for preventing rust and other type corrosion, or strengthening members for localized support.

With the tube members joined in the manner described, a pole construction 10 results without any butt welding. Thus the problem inherent with butt weld-type construction of poles is completely eliminated. Accordingly, it should now be clearly understood how this invention provides these advantages in pole construction described in the introduction portion of this specification. It should also be clear that this invention provides a pole construction which has a telescoping form in which the joints between the tube members are free of any mechanical supports such as ledges, transverse pins or the like but rather are simply formed of a non-metallic, non-shrinking material. In that simple, inexpensively formed construction this invention realizes a pole which resists both large axial tension and compression loads as well as bending moments imparted to the overall pole construction. Since the pole of this invention resists vertical tension or uplifting forces it is particularly suited for use in construction H-frame type electrical transmission support structures which are subject to uplifting vertical forces.

Various other ways within the scope of the method of the present invention are contemplated for forming the pole construction 10. One such other way would be to secure non-structural rings to the tubes members at their respective ends. The smaller tube member would be inserted within the larger tube member and positioned with respect thereto such that the joint annulus is provided. Suitable joint material could then be directed into the joint annulus through an opening provided in the wall of the larger tube member.

While we have shown and described a present preferred embodiment of this invention and have also described a present preferred method of forming the embodiment, it is to be distinctly understood that the invention is not limited thereto, but may be otherwise variously embodied and formed within the scope of the following claims.

We claim:

1. A pole construction comprising: a plurality of longitudinally aligned elongated structural tube members, each of said tube members being of generally uniform outer dimensions, all of said tube members having progressively decreasing outer dimensions with respect to each other, with one end section of a larger dimension tube member overlapping in spaced relationship to the end section of the next smaller dimensioned tube member;

an annular body of non-metallic, non-shrinking means filling the spaces between the overlapping end sections of said tube members and adhering to the opposing surfaces of the overlapping end sections for rigidly securing said overlapping tube members to each other;

said tube members and said annular body being constructed and arranged with respect to each other such that the joints formed between said tube members resists both axial tension and compression loads as well as bending moment imparted to the tube members; and said tube members having their respective interiors generally unobstructed with respect to any structural filler material therein except within said space between said overlapping tube members.

2. A pole construction as set forth in claim 1 wherein said tube members are cylindrically shaped.

3. A pole construction as set forth in claim 1 wherein said tube members are axially aligned and said overlapping tube members are concentric with each other.

4. A pole construction as set forth in claim 1 wherein said tube members are made of a metallic material.

5. A pole construction as set forth in claim 1 including spacer means within the annular space between said overlapping tube members for positioning the tube members with respect to each other.

6. A pole construction as set forth in claim 1 including shear connection means disposed within the space between said overlapping tube members.

7. A method of making a pole construction having a telescoping shape, comprising the steps of:

longitudinally aligning elongated tubular members of different outer dimensions;

positioning the larger dimensioned tubular members such that one end section overlaps the end sections of the smaller dimensioned tubular member;

filling only a substantial portion of the space between the overlapping tubular members with a non-metallic, non-shrinking material to rigidly secure the tubular members to each other while maintaining the remaining interior spaces of the tubular members essentially free of any of said material; and said positioning and said filling being performed in a manner such that said tubular members are secured by a joint which resists both axial tension and compression loads as well as bending moments imparted to said tubular members.

* * * * *